United States Patent [19]

Green, Sr.

[11] Patent Number: 4,837,559

[45] Date of Patent: Jun. 6, 1989

[54] PERSONAL SECURITY DEVICE

[76] Inventor: James G. Green, Sr., 105 Knollwood Dr., Greensboro, N.C. 27403

[21] Appl. No.: 131,198

[22] Filed: Dec. 10, 1987

[51] Int. Cl.[4] ..... G08B 23/00

[52] U.S. Cl. ..... 340/573; 340/571; 340/572; 340/514

[58] Field of Search ..... 340/568, 572, 573, 574, 340/321, 571

[56] References Cited

U.S. PATENT DOCUMENTS

| | | | |
|---|---|---|---|
| 2,834,315 | 5/1958 | Simpson | 340/83 |
| 3,832,705 | 8/1974 | King et al. | 340/571 |
| 4,158,197 | 6/1979 | Takagaki | 340/574 |
| 4,319,309 | 3/1982 | Benoid | 340/321 |

*Primary Examiner*—Joseph A. Orsino
*Assistant Examiner*—Annie H. Chan
*Attorney, Agent, or Firm*—Olive & Olive

[57] ABSTRACT

A personal security device comprises a housing which encloses a battery and an electrically energized signal device such as one or both a buzzer or lamp in series in a normally open circuit. A clip supports the housing on the body of the user and incorporates means for automatically closing the circuit whenever the clip is removed from the body to produce the desired audible or visible signal or both. The housing is shaped so as to maximize opportunity for the sound to be heard or light signal to be seen when the security device is thrown to the ground in an emergency.

7 Claims, 2 Drawing Sheets

PERSONAL SECURITY DEVICE

BACKGROUND OF THE INVENTION

1. Field of the Invention

The present invention relates generally to security devices, and in particular is concerned with a personal security device which is supported on the wearer and automatically activates when removed from its support.

2. Description of the Related Art

Personal security devices are particularly desirable for persons who are alone at times, e.g., walkers, joggers. Conventional security devices are known which can be carried by the wearer. In the event of an emergency, the conventional security device is typically activated by some form of switch to signal for aid.

A disadvantage of the conventional personal security device is thus that the user must locate a switch or trigger to activate the device. In an emergency, the user may be unable to locate or maneuver the switch, thereby rendering the device useless. In some instances, the trigger or switch may become jammed or inoperative. Also, the user may lose the device (e.g., in a struggle) before it is activated. In other personal protection devices, the user is required to position a spray can to deter an attacker. When attacked, the victim may not be able to properly orient and aim the spray nozzle.

U.S. Pat. No. 2,834,315 issued to Simpson in 1958 discloses a personal safety alarm which provides an audible and visible signal for aid. A spring loaded actuating bar activates the alarm when a user releases the device.

U.S. Pat. No. 4,449,474 issued to Mariol in 1984 discloses a personal security device which contains a canister of pressurized gas having an offensive odor. As the gas escapes from the canister, it emits a loud shrieking noise. The alarm is activated by a trigger.

Consequently, a need exists for improvements in personal security devices. It is desirable that a personal security device be portable and easily supported on the wearer. Additionally, it is desirable that a personal security device be such that it can be automatically activated when removed from its support, without requiring use of a conventional trigger or switch. Furthermore, it is desirable that an audio alarm emitted by an improved personal security device facilitate the emittance of sound regardless of the location of the device. The achieving of these various needed improvements becomes the object of the invention. Other objects will appear as the description proceeds.

SUMMARY OF THE INVENTION

The present invention comprises a personal security device that is easily carried by the wearer and is illustrated as having a belt clip support. To actuate the device, the wearer simply removes the device from its belt support. The device includes a specially shaped cover which facilitates the emittance of sound from any position and may include both audio and visual signals.

The device of the invention, as illustrated, comprises a personal security device having a base plate and a cover comprising a housing. A battery energized audio alarm is mounted on the base plate and is electrically connected to an open circuit having a pair of contacts. A resilient clip on the base plate supports the device on the wearer in a first position and includes an electrically conductive strip which closes the circuit when the clip is removed from its support and assumes a second position. A multi-surface cover is mounted on the base plate to shield the audio alarm and is shaped so as to always cause at least one surface and normally several surfaces to rest in a sound transmitting position when thrown to the ground in an emergency. The device is carried on a wearer's belt or other article of clothing by the clip. To activate the audio alarm, the device is removed from the clothing which allows the conductive strip to engage and connect the contacts to close the circuit and energize the alarm. In alternate embodiments, one or more electrically energized lamps are incorporated in the device.

DESCRIPTION OF THE PREFERRED EMBODIMENT

Figure 1:
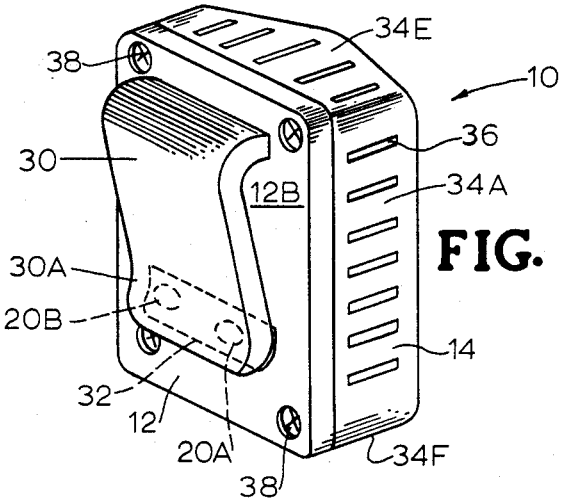
FIG. 1 is a back perspective view of a first embodiment of the personal security device of the invention illustrating the clip mounted conductive strip and electrical contacts.
Figure 2:
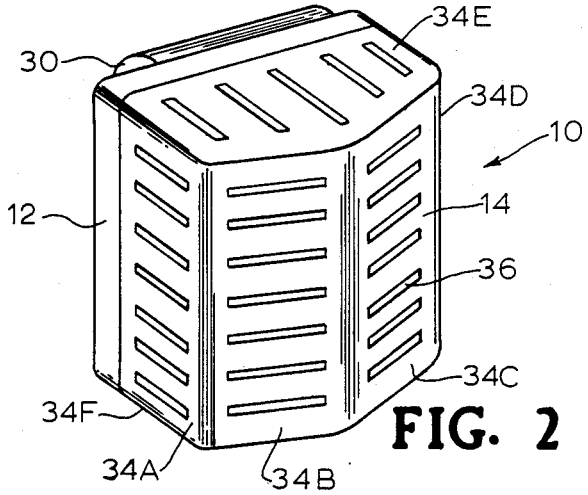
FIG. 2 is a front perspective view of the personal security device of FIG. 1 illustrating its multi-surface cover.
Figure 3:
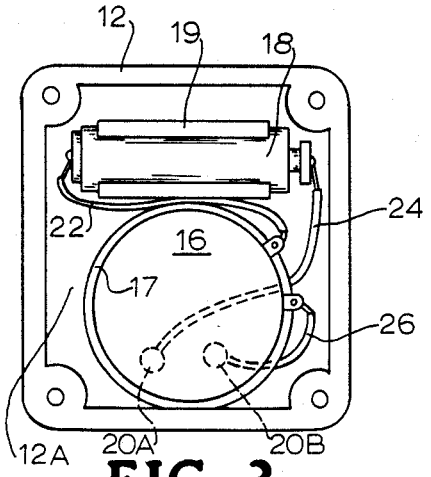
FIG. 3 is a front elevational view of the personal security device of FIG. 1 with the cover removed.

A first preferred embodiment of the personal security device of the invention, indicated generally at 10, is illustrated in FIGS. 1–4. The device 10 includes a base plate 12 and a cover 14 with a plastic molded construction being preferred.

Base plate 12 is generally a planar member having an inner surface 12A and outer surface 12B. It is desirable that base plate 12 be a substantially rectangular member, constructed and arranged to be carried easily on a wearer's belt or other article of clothing by means of the later referred to clip 30.

An audio alarm 16, for example a buzzer or a horn, is mounted within a retaining wall 17 on inner surface 12A of base plate 12. A battery 18 is mounted within a resilient retaining clip 19 to the inner surface 12A. A pair of electrical contacts 20A and 20B are mounted in base plate 12 so that each contact 20A and 20B is accessible from both inner surface 12A and outer surface 12B of base plate 12.

An open circuit series connection is made with audio alarm 16, battery 18 and contacts 20A and 20B. One side of battery 18 is electrically connected to one side of audio alarm 16 by wire 22. An opposite side of battery 18 is electrically connected to contact 20A by wire 24. The opposite side of audio alarm 16 is electrically connected to contact 20B by wire 26. Thus, alarm 16 is energized whenever contacts 20A and 20B are connected.

A clip 30 is provided on outer surface 12B of base plate 12. Clip 30 is designed to engage a wearer's belt or other article of clothing to support device 10 on the wearer. The lower and inside portion 30A of clip 30 mounts an electrically conductive contact strip 32 opposite contacts 20A and 20B. Alternatively, at least the lower portion 30A of clip 30 can be constructed from an electrically conductive material, thereby eliminating the need for contact strip 32. From what has been described it will be readily understood that whenever clip 30 is removed from its clothing support strip 32 bridges contacts 20A and 20B and thus automatically completes the circuit to energize alarm 16.

Cover 14 is a multi-surface member and desirably has an expanded V-shape for reasons which will become apparent. In a preferred embodiment, cover 14 includes at least four side surfaces 34A, 34B, 34C and 34D, and top surface 34E and bottom surface 34F. Cover 14 is preferably constructed from a break-resistant, lightweight plastic molded material. Sound louvers 36 are provided in surfaces 34A–34F to facilitate the emittance of sound from audio alarm 16. It will of course be understood that other cover designs are within the scope of the present invention.

When security device 10 is assembled, cover 14 is removably secured to base plate 12 in any suitable manner, e.g., by fasteners 38. (see FIG. 1) Alternatively, cover 14 can be snap-fitted to base plate 12.

In operation, security device 10 is secured to a wearer's belt or other normally electrically insulating article of clothing by clip 30 so that the belt or clothing material is inserted between contact strip 32 and contacts 20A and 20B. When the belt or clothing material is received between contact strip 32 and contacts 20A and 20B, the circuit is thus open and audio alarm 16 is not activated. In an emergency, the wearer removes security device 10 from his or her belt or other article of clothing on which device 10 is supported thereby permitting contact strip 32 to engage contacts 20A and 20B to close the circuit and activate audio alarm 16.

Figure 4:
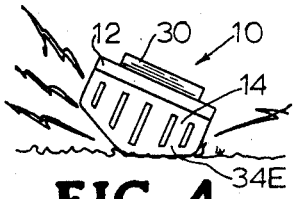
FIG. 4 is an end elevational view of the personal security device of FIG. 1 illustrated with one cover surface engaging a supporting surface and other cover surfaces positioned to permit emission of the alarm sound.

A user may fling or toss security device 10 to the ground. As illustrated in FIG. 4, the multi-surface design of cover 14 facilitates emittance of sound since at least one and typically several surfaces of surfaces 34A–34F will be free to emit sound and not be adjacent the ground. Sound emittance is thus not muffled by those open slots or louvers 36 which are not in contact with the ground. In addition to signaling for aid, an assailant may investigate security device 10 and permit a user to escape.

When the security device is stored, a flat spacer (not illustrated) of any suitable electrically non-conductive material is inserted between contact strip 32 and contacts 20A and 20B to keep the circuit open. Of course, battery 18 could also be removed from base plate 12 to disengage the circuit.

Figure 5:
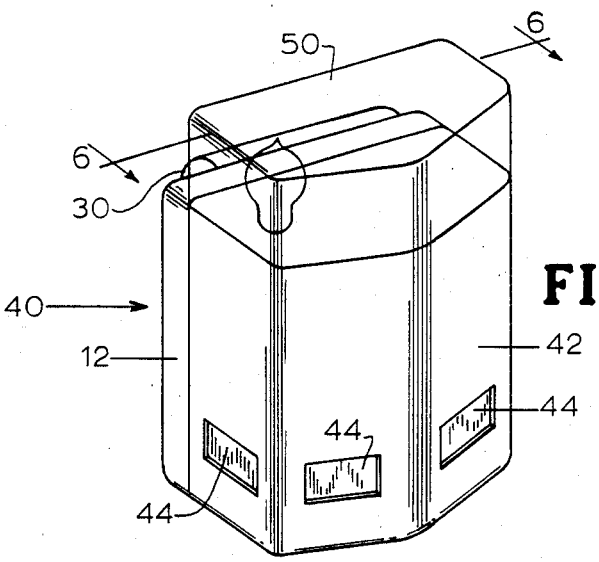
FIG. 5 is a front perspective view of a second embodiment of the invention having a lamp as an auxiliary visual signal.
Figure 6:
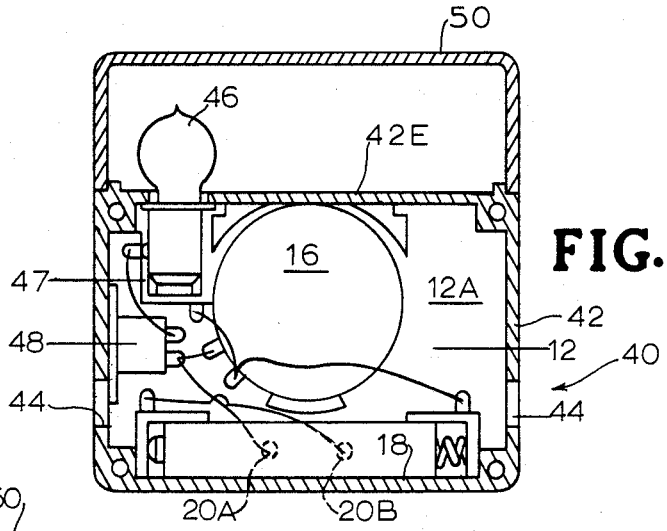
FIG. 6 is a sectional view taken along line 6—6 of FIG. 5.

A second embodiment of the personal security device indicated generally at 40, is illustrated in FIGS. 5 and 6. For purposes of clarity, all identical elements of each embodiment of the invention have the same reference numerals.

Security device 40 is formed as a substantially waterproof device and includes an expanded V-shape cover 42, similar to cover 14, removably secured to base plate 12. Cover 42 includes waterproof sound louvers 44 to facilitate the emittance of sound from alarm device 40. Sound louvers 44 can, for example, be, waterproofed with a layer of waterproof material, e.g., sheet rubber, secured to the inner surface of cover 42. Of course, cover 14 with sound louvers 36 could be substituted for cover 42.

As illustrated in FIG. 6, base plate 12 includes a circuit having audio alarm 16, battery 18 and contacts 20A and 20B. A visual lamp 46, is mounted on base plate 12 by retaining wall 47 and is electrically connected in series with the circuit. A flasher 48 is electrically connected in series with lamp 46 and is mounted on cover 42.

A dome 50, constructed from a substantially transparent material, is secured to end surface 42E of cover 42 by any suitable manner, e. g., by fasteners (not illustrated) or a snap fit, to protect lamp 46.

In operation, a wearer removes security device 40 from his or her belt or other article of clothing to permit engagement of contact strip 32 and contacts 20A and 20B, thereby closing the alarm circuit and activating alarm 16 and visual lamp 46 causing visual lamp 46 to intermittently flash by reason of being electrically connected to flasher 48.

Figure 7:
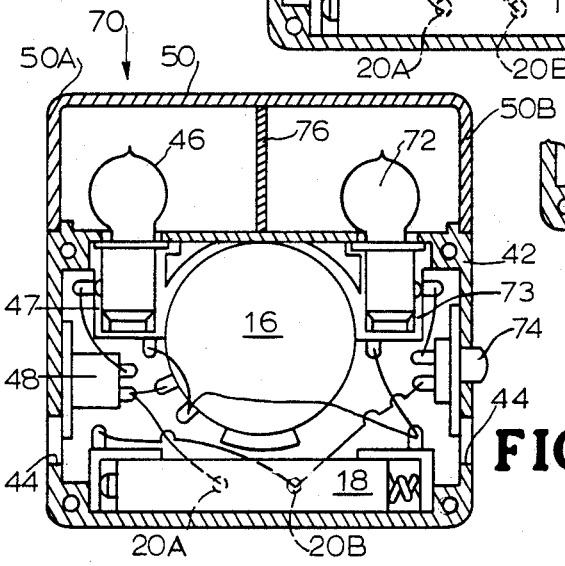
FIG. 7 is a sectional view of a third embodiment of the invention having a pair of lamps one of which permits an auxiliary visual signal and the other of which through an auxiliary manual switch permits use as a flashlight.

A third preferred embodiment of the personal security device, indicated generally at 70, is illustrated in FIG. 7. Security device 70 includes all of the elements of device 40, a second lamp 72 and a switch 74.

Lamp 72 is mounted on base plate 12 by retaining wall 73 and is connected in series with battery 18 and switch 74. Switch 74 illustrated as mounted on cover 42 is electrically connected to lamp 72 to permit selective on-off operation of lamp 72 independent of the position of clip 30. Thus, lamp 72 can be worn as a light signal or used as a flashlight.

Dome 50, constructed from substantially transparent material, is divided into two portions 50A and 50B, and includes an inner partition 76. Portion 50A, surrounding lamp 46, is constructed from a red, amber or other colored transparent material. Portion 50B, surrounding lamp 72, is constructed from a clear, transparent material. Partition 76 can be opaque or transparent as desired. In the alternative, lamp 46 can be colored, e.g., red, and both portions 50A and 50B of dome 50 made from a clear, transparent material.

In operation, a wearer removes security device 70 from his or her belt or other article of clothing to activate audio alarm 16 and flashing lamp 46. The wearer also has the option of activating lamp 72 by switch 74 to provide light without activating audio alarm 16 or lamp 46 or removing device 70 from his or her clothing.

Figure 8:
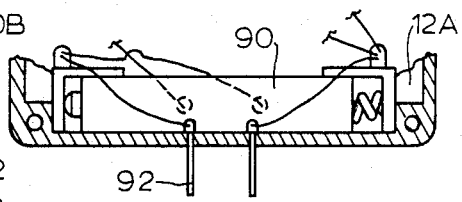
FIG. 8 is a partial front elevational view of the personal security device of the invention illustrated in a fourth embodiment as having a rechargeable battery and means for connecting the rechargeable battery to a recharging source.

As illustrated in FIG. 8, it is desirable to provide a rechargeable battery 90 with any embodiment 10, 40, or 70 of the invention. Prongs 92 can be electrically connected to rechargeable battery 90 and extend from base plate 12 or cover 14 to receive a charger (not illustrated) or other source of power. It is desirable that prongs 92 pivot or retract into base plate 12 or cover 14, 42 when not recharging.

Gaskets (not illustrated) or other appropriate waterproofing elements are included between base plate 12 and cover 14, 42 to prevent water from entering alarm device 10, 40 or 70. It is also desirable that dome 50 be sufficiently sized so that alarm device 40 or 70 will float upright in water.

In the simplest embodiment, the present invention comprises a personal security device 10, 40 or 70 having a self-activated signal in the form of either or both sound and light alarm 16 from alarm 16 and lamp 46. The security means is thus dependent upon clip 30 being removed from a mounted position on the belt or other article of clothing of a wearer to a non-mounted position. In other words, the personal security device provides a signal in the form of either or both alarm 16 and lamp 46 activated by a position-sensitive switche assembly comprising clip 30, conductive strip 32 and contacts 20A, 20B. It is contemplated that the greatest use of the invention will be as a body mounted device. However, it is also recognized that an invalid could clip the invention device to a bed sheet and produce a signal by removing the device from the sheet. It is also recognized that a student, for example could clip the device to a book, a clipboard or the like and initiate a signal by removing the device from such book, clipboard or the like.

Although the present invention has been described with reference to preferred embodiments, workers skilled in the art will recognize that changes may be made in form and detail without departing from the spirit and scope of the invention.

What is claimed is:

1. A portable personal security device, comprising:

a. a housing having a back surface mounting a flexible clip for receiving an article such as a belt for supporting the housing on the body of the user;

b. an electrically energized signalling device enclosed in said housing;

c. a battery enclosed in said housing;

d. a circuit connecting said signalling device and battery in series enclosed in said housing; and e. circuit closure means associated with said clip and arranged to be opened by said article when received by said clip to maintain said circuit normally open and to close when said clip is removed from said article to complete said circuit and allow said battery to energize said signalling device.

2. A portable personal security device as claimed in claim 1 wherein said signalling device is audible when energized and said housing is formed with sound transmitting apertures.

3. A portable personal security device as claimed in claim 1 wherein said signalling device comprises a lamp and said housing surrounding said lamp is formed to transmit signalling light therefrom.

4. A portable personal security device as claimed in claim 1 wherein said circuit includes a pair of normally disconnected contacts and aid circuit closure means includes an electrically conductive strip mounted on said clip and operative to connect said contacts and thereby close said circuit when said clip is removed form said article.

5. A portable personal security device as claimed in claim 2 wherein said housing is formed with a plurality of angularly related side surfaces such that said housing when on a ground surface tends to maintain a plurality of such side surfaces in position to transfer sound through said apertures.

6. A portable personal security device as claimed in claim 2 including an electric lamp connected to be energized by said battery when said clip is removed from its body support and mounted in a portion of said housing formed to transmit light therefrom.

7. A portable personal security device as claimed in claim 3 including a second electrical lamp mounted in said housing, an auxiliary switch and associated circuitry enabling said second lamp to be energized by said battery independent of said clip being on or removed from its body support.

* * * * *

UNITED STATES PATENT AND TRADEMARK OFFICE

CERTIFICATE OF CORRECTION

PATENT NO. : 4,837,559

DATED : June 6, 1989

INVENTOR(S) : James G. Green, Sr.

It is certified that error appears in the above-identified patent and that said Letters Patent is hereby corrected as shown below:

Column 5, line 12, correct "switche" to read --switch--.

Column 6, line 17, correct "aid" to read --said--.

Column 6, line 21, correct "form" to read --from--.

Signed and Sealed this

Sixth Day of February, 1990

*Attest:*

JEFFREY M. SAMUELS

*Attesting Officer*

*Acting Commissioner of Patents and Trademarks*